US006763203B2

(12) United States Patent
Yoshioka et al.

(10) Patent No.: US 6,763,203 B2
(45) Date of Patent: Jul. 13, 2004

(54) IMAGE FORMING APPARATUS HAVING TRANSFER BIAS CONTROL FUNCTION

(75) Inventors: Mahito Yoshioka, Shizuoka (JP); Yoji Tomoyuki, Tokyo (JP); Ken Nakagawa, Shizuoka (JP); Hikaru Osada, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/082,156

(22) Filed: Feb. 26, 2002

(65) Prior Publication Data

US 2002/0159784 A1 Oct. 31, 2002

(30) Foreign Application Priority Data

Feb. 28, 2001 (JP) ..... 2001-054526
Feb. 13, 2002 (JP) ..... 2002-035283

(51) Int. Cl.[7] ..... G03G 15/16
(52) U.S. Cl. ..... 399/66; 399/45
(58) Field of Search ..... 399/66, 314, 55, 399/45

(56) References Cited

U.S. PATENT DOCUMENTS

| | | | | |
|---|---|---|---|---|
| 5,148,226 A | | 9/1992 | Setoriyama et al. | 355/290 |
| 5,250,999 A | * | 10/1993 | Kimura et al. | 399/66 |
| 5,331,385 A | * | 7/1994 | Ohtsuka et al. | 399/331 |
| 5,525,775 A | | 6/1996 | Setoriyama et al. | 219/216 |
| 5,995,794 A | | 11/1999 | Osada et al. | 399/302 |
| 6,253,041 B1 | * | 6/2001 | Tomizawa et al. | 399/66 |

FOREIGN PATENT DOCUMENTS

| | | | |
|---|---|---|---|
| JP | 62090674 A | * | 4/1987 |
| JP | 4-44075 | | 2/1992 |
| JP | 4-44076 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 7-20672 | | 1/1995 |

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

The image forming apparatus has an image bearing member for transferring an image from the image bearing member to a recording material, a fixing device for fixing an image onto the recording material, the fixing device having a heating member and back-up roller for forming a nip in cooperation with the heating member. In the image forming apparatus, a normal mode for a case in which the recording material is paper and a resin sheet mode for a case in which the recording material is resin, and wherein when the resin sheet mode is selected a voltage applied to said transfer member is lower than that of the case in which the normal mode is selected so that an absolute value of a front surface potential of the resin sheet becomes small.

4 Claims, 6 Drawing Sheets

IMAGE FORMING APPARATUS HAVING TRANSFER BIAS CONTROL FUNCTION

BACKGROUND OF THE INVENTION

1. Field of the Invention

The present invention relates to an image forming apparatus such as a copying machine, a printer and a facsimile machine and, in particular, to an image forming apparatus having a function of transferring an image formed on an image bearing member to a recording material and thereafter fixing the image thereon.

2. Related Art

An electrophotographic image forming apparatus is an example of such an image forming apparatus. With the electrophotographic image forming apparatus, an unfixed toner image corresponding to target image information is formed and borne on an image bearing member such as an electrophotographic photosensitive body by an image forming process using a heat-fixing visualizing agent (toner). The toner image is transferred by a transferring apparatus from the image bearing member onto a recording material, and the recording material having undergone the transfer of the toner image is introduced into a heating apparatus (heat-fixing apparatus), whereby the toner image is subject to a heat-fixing treatment as a permanently fixed image to be discharged as an image formed object (copy, print).

As the transferring apparatus used in such an image forming apparatus, a transferring apparatus of a noncontacting electrostatic transfer method is often used according to the recent tendency to eliminate ozone. The transferring apparatus of the noncontacting electrostatic transfer method is for applying a predetermined transfer bias from a power source to a transfer member such as a transfer roller located on a back side of a recording material, thereby attracting a toner image from an image bearing member with an electric force and transferring it onto the recording material.

As a heating apparatus for heat-fixing a toner image on a recording material, a heating apparatus is generally used which brings a pressurizing roller having elasticity in pressed contact with a rotational heating member having a built-in heat source such as a fixing roller or a fixing film and introduces a recording material to its press-contacting nip portion to perform a fixing operation of the toner image.

A pressurizing roller as a pressurizing member used in the above-mentioned heating apparatus is often provided with a heat-resistant elastic body such as silicone rubber on a core metal, which is supporting body and has rigidity and further, provided with a fluorocarbon resin layer, if necessary. The heat-resistant elastic body is required for its function as a part constituting the rotational heating member and the press-contacting nip portion. The surface layer may be provided for the purpose of improving a releasing property in order to avoid stains when adhesion and deposition of dirty toner or recording material components caused by offset or the like on the side of the rotational heating member are serious on the surface of the pressurizing roller.

However, a rubber material or a resin material, which is generally used as an elastic layer or a surface layer, is often an insulator. Thus, when dried paper with a high electric resistance as a recording material is passed through the pressurizing roller, the surface of the pressurizing roller is charged negatively due to friction with the paper. If toner held on the paper at this point is negatively charged toner, the toner repulses a triboelectrification potential of the surface of the pressurizing roller, resulting in a scattered image or an offset image.

A pressurizing roller is proposed in which a conductive material is dispersed in a rubber material or a resin material used for an elastic layer or a surface layer and treatment for lowering resistance is applied to the elastic layer or the surface layer in order to avoid such triboelectrification on the surface of the pressurizing roller. A resistance of one or more of these layers is reduced to $10^{13}$ Ω/sq or less in terms of a surface resistance or $10^{11}$ Ωcm or less in terms of a volume resistance. The layers with a reduced resistance are electrically grounded, whereby triboelectrification of the surface of the pressurizing roller can be prevented.

However, when an OHT (overhead transfer: a transparent recording sheet for an overhead projector) is used as a recording material to be passed through an apparatus provided with a pressurizing roller (conductive pressurizing roller) which has been subject to treatment for lowering resistance as described above, charges on the back of the OHT, which the pressurizing roller contacts, may flow to the ground to offset an image on the surface of the OHT.

In general, an OHT is made of a PET (polyethylene terephthalate) sheet coated with a surface-active agent or the like on its surface. Therefore, it has high insulating property in its thickness direction, but has a lower surface resistance. Due to such a condenser construction, if negatively charged toner is used, the OHT is subject to a positive transfer bias on its back when passing through a transfer portion. At this point, negative charges are induced on the surface of the OHT. In this state, the negative charges electrostatically balance with positive charges on the back of the OHT. However, if the OHT contacts a pressurizing roller, which has been subject to treatment for lowering resistance when passing through a fixing nip, the positive charges (transfer charges) on the entire back of the OHT flow to the ground. Thus, the front of the OHT is largely occupied by the negative charges and the negatively charged toner repulses the negative charges to have a weaker holding force, resulting in an offset image.

Further, when a recording material is plain paper, since it has lower insulating property in its thickness direction and a higher surface resistance in comparison with the OHT, such an offset image does not occur.

SUMMARY OF THE INVENTION

The present invention has been devised in view of the above-mentioned drawbacks, and it is an object of the present invention to provide an image forming apparatus that can suppress offset of an image.

It is another object of the present invention to provide an image forming apparatus that can suppress offset of an image regardless of a type of a recording material.

It is still another object of the present invention to provide an image forming apparatus that can suppress offset of an image even if a resin sheet is passed through fixing means provided with a pressurizing roller having a low resistance layer.

It is yet still another object of the present invention to provide an image forming apparatus including: an image bearing member; a transfer member for transferring an image from the image bearing member to a recording material; fixing means for fixing an image onto the recording material, the fixing means including a heating member and back-up roller for forming a nip cooperation with the heating member, in which the back-up roller has a conductive material containing layer; and in which a voltage applied to the transfer member when the recording material is a resin sheet is lower than a voltage applied thereto when the recording material is paper.

Other objects of the present invention will be more apparent from the following detailed description with reference to the accompanying drawings.

DESCRIPTION OF THE PREFERRED EMBODIMENTS

Figure 1:
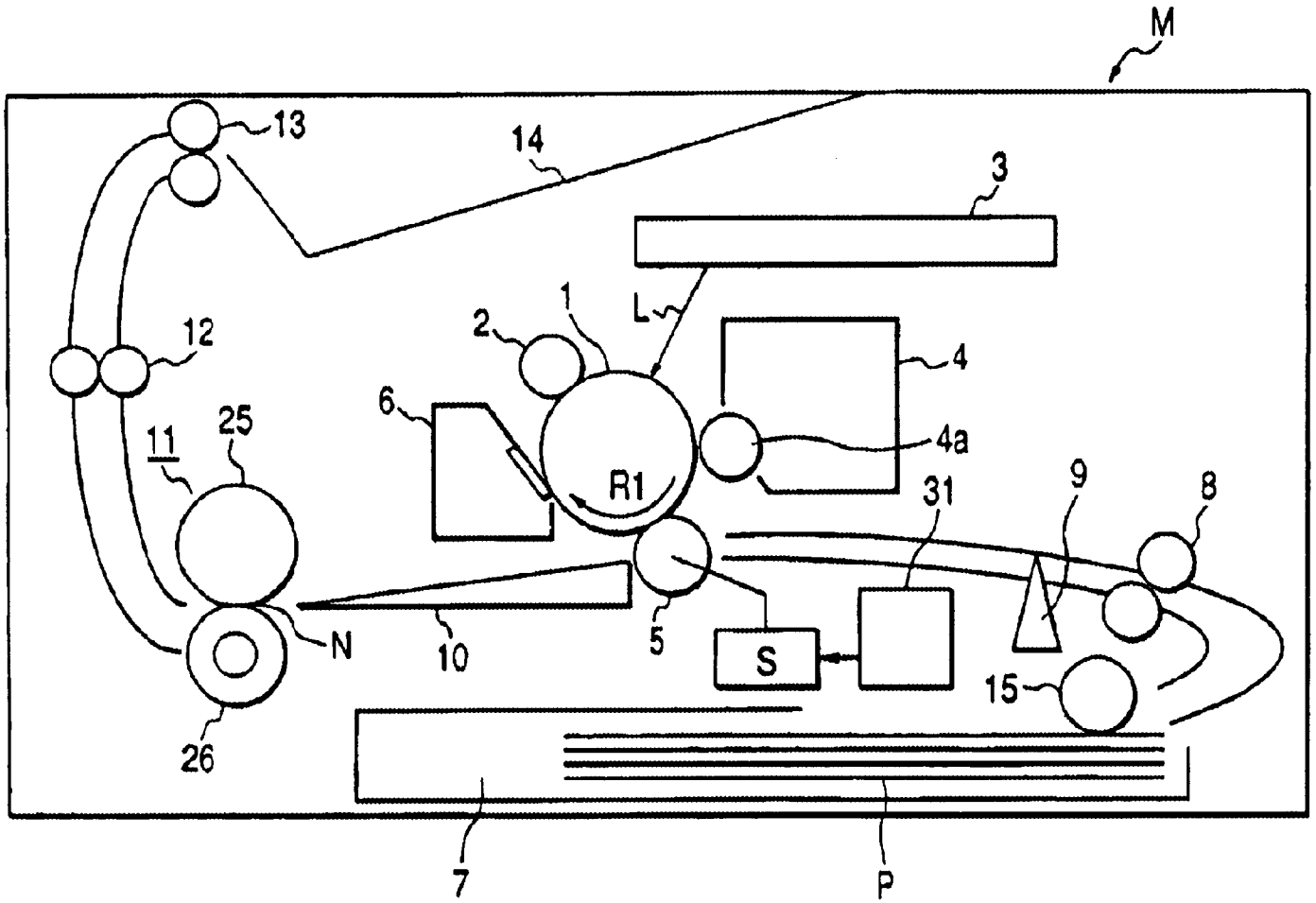
FIG. 1 is a schematic view showing a configuration of an image forming apparatus in accordance with a first embodiment.

Embodiments of the present invention will be hereinafter described with reference to the accompanying drawings.

In addition, in the accompanying drawings, like reference numerals designate the same or similar parts throughout the figures thereof.

<First embodiment>

(1) Image forming apparatus

FIG. 1 is a schematic view showing a configuration of an image forming apparatus in accordance with this embodiment. The image forming apparatus of this embodiment is a laser beam printer utilizing an electrophotographic process.

Reference numeral 1 denotes a drum-type electrophotographic photosensitive body (hereinafter referred to as "photosensitive drum") as an image bearing member. The photosensitive drum 1 is rotatably supported by an apparatus main body M and is driven to rotate in an arrow R1 direction at a predetermined process speed by driving means (not shown).

A charging roller (charging apparatus) 2, exposing means 3, a developing apparatus 4, a transfer roller (transferring apparatus) 5 and a cleaning apparatus 6 are arranged in this order around the photosensitive drum 1 along its rotational direction.

In addition, a sheet feeding cassette 7 containing sheet-like recording materials P such as paper is arranged in the lower part of the apparatus main body M. Above the sheet feeding cassette 7, a sheet feeding roller 15, a conveying roller pair 8, a top sensor 9, a conveying guide 10, a fixing apparatus (heating apparatus) 11, a conveying roller pair 12, a sheet discharging roller pair 13 and a sheet discharging tray 14 are arranged in this order from an upstream side along a conveying path of the recording material P.

The photosensitive drum 1 driven to rotate in the arrow R1 direction by the driving means is uniformly charged to a predetermined polarity and a predetermined potential by the charging roller 2 to which a predetermined charging bias is applied from a not-shown charging bias power source.

After charging, the photosensitive drum 1 is subject to image exposure L on its surface based on image information by the exposing means 3 such as a laser optical system. Then, charges on an exposed portion are removed from the photosensitive drum 1 and an electrostatic latent image is formed thereon.

The electrostatic latent image is developed by the developing apparatus 4. The developing apparatus 4 has a developing roller 4*a*, applies a predetermined developing bias to the developing roller 4*a* from a not-shown developing bias power source and causes toner to adhere to the electrostatic latent image on the photosensitive drum 1, thereby developing the electrostatic latent image as a toner image (visualization).

The toner image is transferred onto the recording material P such as paper by the transfer roller 5. The recording material P is contained in the sheet feeding cassette 7, fed and conveyed by the sheet feeding roller 15 and the conveying roller pair 8 and conveyed to a transfer nip portion that is a pressing-contact nip portion between the photosensitive drum 1 and the transfer roller 5 via the top sensor 9. At this point, a tip of the recording material P is detected by the top sensor 9 and is synchronized with the toner image on the photosensitive drum 1.

A predetermined transfer bias is applied to the transfer roller 5 by a transfer bias power source S at predetermined control timing, whereby the toner image on the photosensitive drum 1 is electrostatically transferred on the recording material P at a predetermined position. Reference numeral 31 denotes a control circuit (CPU) for controlling a transfer bias voltage outputted by the transfer bias power source S.

The recording material P with an unfixed toner image borne on its surface by the transfer is separated from the surface of the photosensitive drum and conveyed to the fixing apparatus 11 along the conveying guide 10. In the fixing apparatus 11, the unfixed toner image is heated and pressurized to be fixed on the surface of the recording material.

The recording material P having been fixed with the toner image is conveyed by the conveying roller pair 12 and discharged onto the sheet discharging tray 14 on the upper surface of the apparatus main body M by the discharging roller pair 13.

On the other hand, after the toner image is transferred, toner which is not transferred and remains on the surface of the photosensitive drum 1 (transfer residual toner) is removed by a cleaning blade 6*a* of the cleaning apparatus 6. The photosensitive drum 1 prepares for the next image formation.

Images can be formed one after another by repeating the above operations.

(2) Fixing apparatus 11

Figure 2:
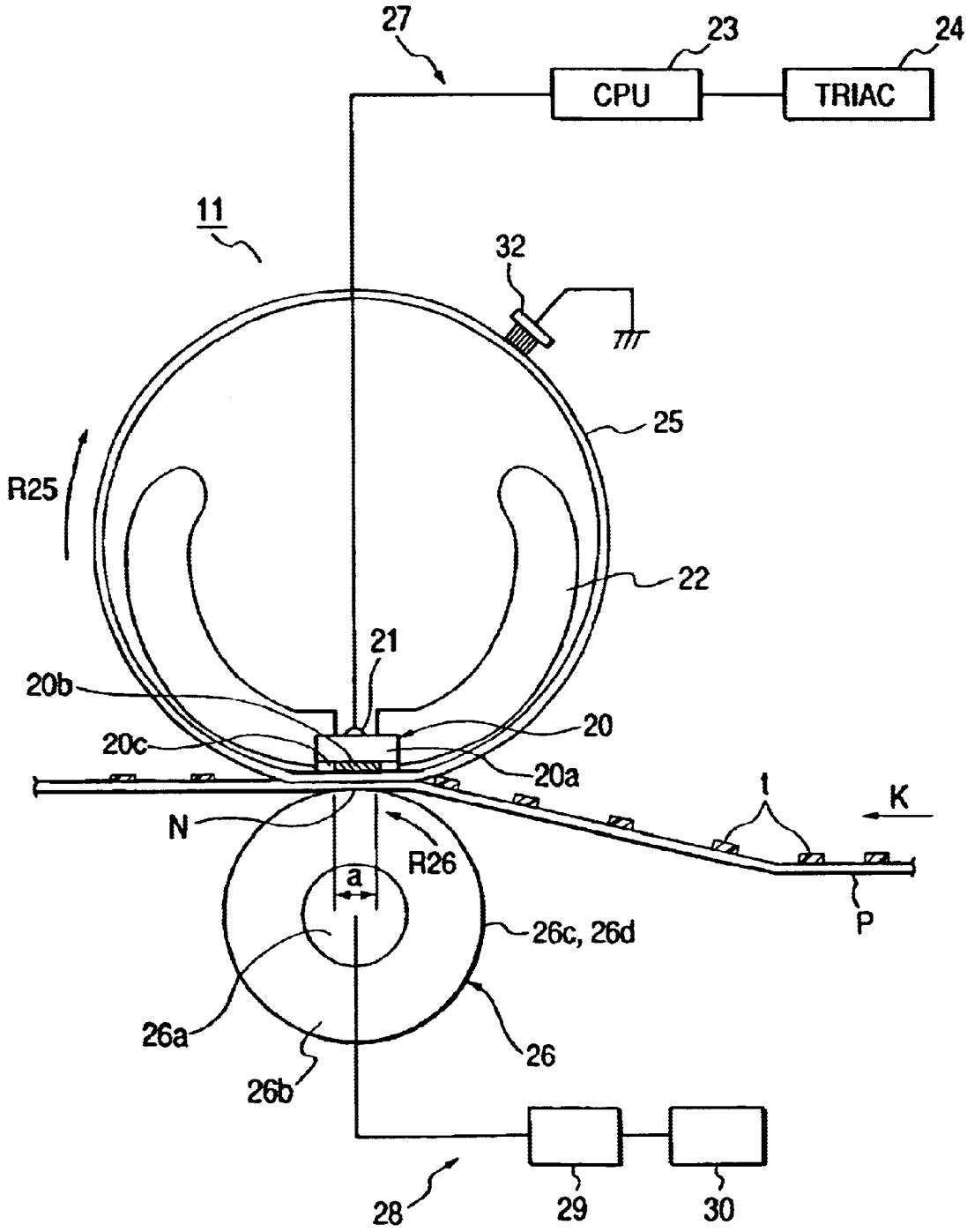
FIG. 2 is a schematic sectional view of a fixing apparatus.

FIG. 2 is a schematic sectional view of the fixing apparatus 11 in this embodiment. The fixing apparatus 11 of this embodiment is a heating apparatus of a pressurizing roller driving method and a film heating method disclosed, for example, in Japanese Patent Applications Laid-open Nos. 4-44075 to 44083.

This fixing apparatus 11 is composed of, as main constituent members, a ceramic heater (hereinafter referred to as "heater") 20 as a heating member for heating toner, a cylindrical fixing film 25 containing the heater 20, a pressurizing roller (back-up roller) 26 for forming a nip in cooperation with the heater 20 via the fixing film 25, temperature control means 27 for controlling a temperature of the heater 20, and rotation control means 28 for controlling the conveyance of the recording material P.

The heater 20 consists of a resistor pattern 20*b* which is formed on a heat-resistant base material 20*a* such as alumina by, for example, printing and which is coated with a glass layer 20*c* over its surface. The heater 20 is long in a right-left direction perpendicular to a conveying direction K of the recording material P, that is, formed to be longer than the width of the recording material P. The heater 20 is supported by a heater holder 22 attached to the apparatus main body M.

The temperature control means 27 for controlling a temperature of the heater 20 includes a thermistor (temperature detecting element) 21 attached to the back of the heater 20 and a CPU 23 for controlling a triac 24 based on a temperature detected by the thermistor 21 and also controlling conduction of the heater 20.

The heat holder 22 is a member formed in a semicircular shape on its cross section by heat-resistant resin and also acts as a guiding member for guiding rotation of the fixing film 25.

The fixing film 25 is heat-resistant resin such as polyimide formed in a cylindrical shape and rotates around the heater 20 and the heater holder 22. The fixing film 25 is pressed against the heater 20 by the pressurizing roller 26, whereby the back of the fixing film 25 is forced to abut the lower surface of the heater 20. The fixing film 25 is constructed so as to be rotated in an arrow R25 direction while the recording material P is conveyed in an arrow K direction by the rotation of the pressurizing roller 26 in an arrow R26 direction.

Further, both the left and right ends of the fixing film 25 are regulated so as not to slant to one side by a guide portion (not shown) of the heat holder 22 and are prevented from coming off in the longitudinal direction of the heater 20. In addition, grease is applied to the internal surface of the fixing film 25 in order to reduce its sliding resistance to the heater 20 and the heater holder 22.

Details of the pressurizing roller 26 will be described later. Briefly, a role of the pressurizing roller 26 is to press the fixing film 25 to the heater 20 upward by its outer circumference, thereby forming a fixing nip portion N between itself and the fixing film 25. Assuming that a width (nip width) of the pressurizing roller 26 in the rotational direction in this fixing nip portion N is a, the nip width a is set to a degree with which the toner on the recording material P can be preferably heated and pressurized.

The rotation control means 28 includes a motor 29 for driving the pressurizing roller 26 to rotate and a CPU 30 for controlling the rotation of the motor 29.

In the state in which the pressurizing roller 26 is driven to rotate, the fixing film 25 rotates following it and the conduction to the heater 20 is controlled to adjust the temperature of the fixing nip portion N to a predetermined fixing temperature, the recording material P bearing the unfixed toner image t is conveyed to the part of the fixing nip portion N between the fixing film 25 and the pressurizing roller 26 to be nipped and conveyed by the fixing nip portion N. As a result, the unfixed toner image t is heated by the heater 20 via the fixing film 25 and fixed by the heat. The recording material P that has passed through the fixing nip portion N is separated from the external surface of the fixing film 25 to be discharged and conveyed.

a) Fixing film 25

Figure 3:
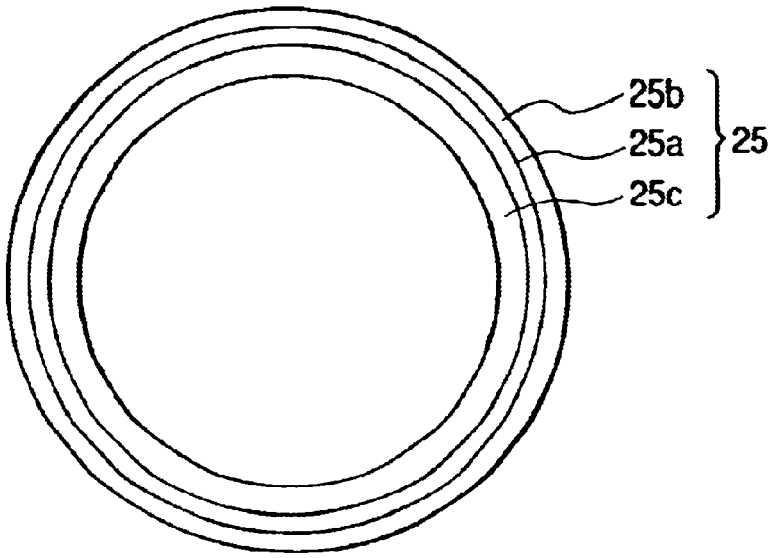
FIG. 3 is a schematic view showing a configuration of layers of a fixing film.

FIG. 3 is a schematic view showing a structure of layers of the fixing film 25. The fixing film 25 of this embodiment has a three-layer structure. An innermost layer is a base layer 25*c*, which has a mechanical property such as torsion strength and smoothness and is made of a resin such as polyimide. The next layer is a conductive primer layer 25*a*. The conductive primer layer 25*a* is a conductive layer in which conductive particles such as carbon black are dispersed and whose resistance is reduced, and assumes a role of an adhesive for joining a third layer 25*b* and the base layer 25*c*. An outermost layer is the top layer 2*b*. The top layer 25*b* is designed with a resistance value and a film thickness that are matched to property of toner used for the image forming apparatus and conditions for constructing the image forming apparatus.

b) Pressurizing roller 26

Figure 4:
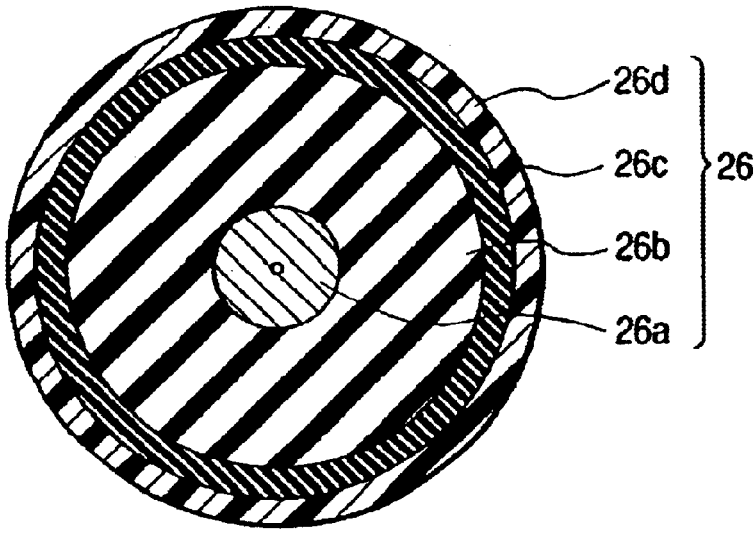
FIG. 4 is a schematic view showing a configuration of layers of a pressurizing roller.

FIG. 4 is a schematic view showing a structure of layers of the pressurizing roller 26. The pressurizing roller 26 has a structure including only an elastic layer 26*b* on a core metal 26 or further including one or more resin layers 26*d* on the elastic layer 26*b*.

As the resin layer 26*d*, it is sufficient to provide a fluorocarbon resin layer or the like when high releasing property is required for the pressurizing roller 26 or, if necessary, to provide a plurality of resin layers when a surface property or the like is adjusted.

The pressurizing roller 26 of this embodiment is provided with a foaming silicone rubber as the elastic layer 26*b* on an aluminum core metal 26*a*. Then, after vulcanization and molding, an RTV silicone rubber, which has been subject to primary processing and has adhesion property, is applied to the foaming silicone rubber as an adhesive layer 26*c*. Moreover, an injection molded PFA tube is coated over the RTV silicone rubber as the resin layer (releasing layer) 26*d*.

Here, in the present invention, a resistance of an elastic layer provided on a core metal or a resistance one or more resin layers on the elastic layer is adjusted to be $10^{13}$ Ω/sq or less in terms of a surface resistance or $10^{11}$ Ωcm or less in terms of a volume resistance by dispersing conductive particles such as carbon black in these layers.

If the elastic layer provided on the core metal or the resin layers have a surface resistance of $10^{13}$ Ω/sq or more, since an electric resistance is too large, triboelectrification generated between high resistance paper (recording material) and a surface of a pressurizing roller cannot be flown to the ground. In this embodiment, carbon black is dispersed in the RTV silicone rubber of the adhesive layer 26*c*, whereby the surface resistance is adjusted to $10^{10}$ Ω/sq. In addition, although the PFA tube of the releasing layer 26*d* is an insulator, since its film thickness is set at 20 μm, a withstand voltage of its surface can be kept low (approximately 2 kV or less) and charges generated on the surface of the pressurizing roller 26 by friction with the recording material P can be flown to the resistance-adjusted adhesive layer 26*c* immediately below the resin layer 26*d*.

c) Ground structure of the pressurizing roller 26

Figure 5:
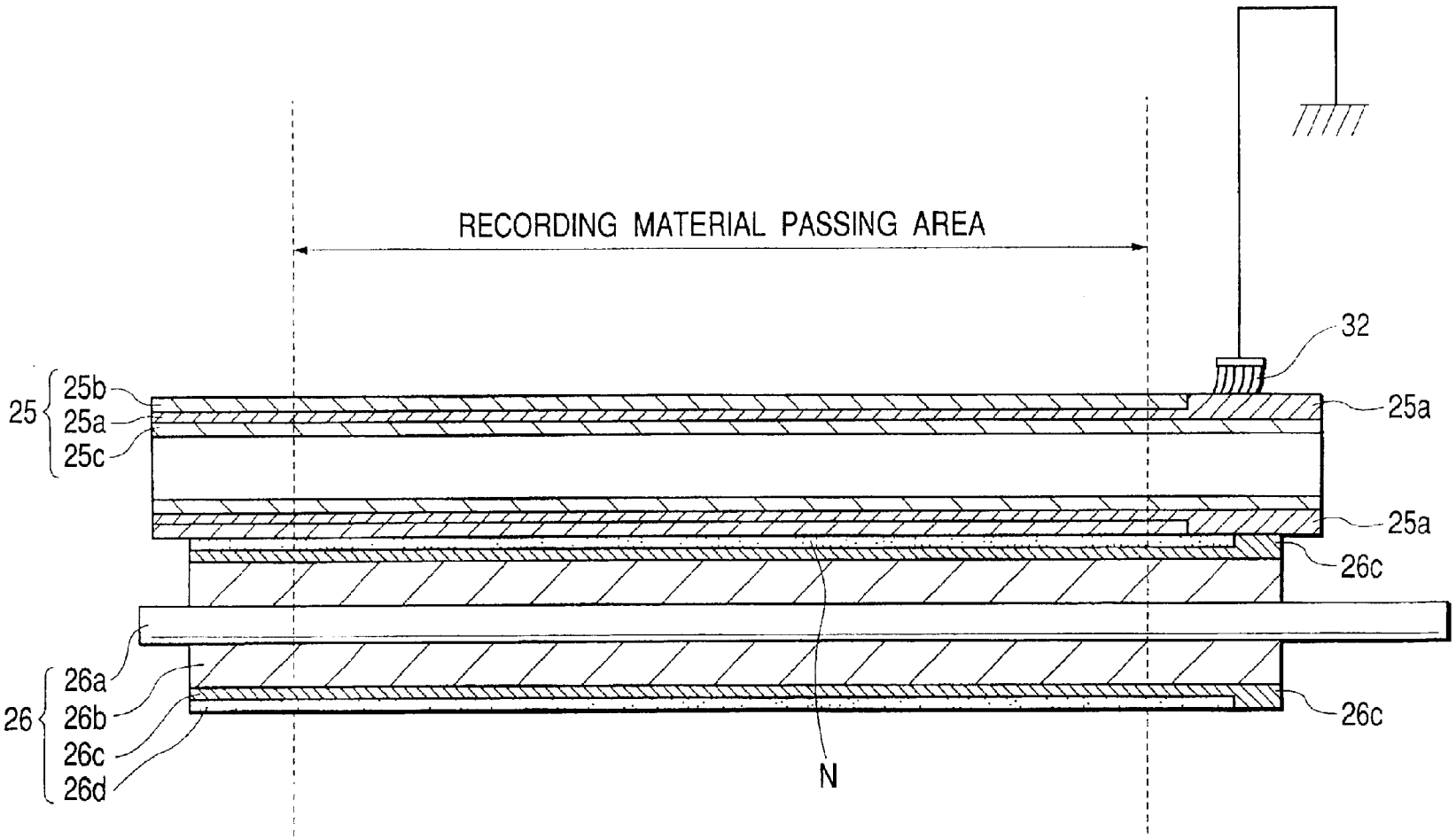
FIG. 5 is a schematic view for illustrating a ground structure of the fixing film and the pressurizing roller.

As shown in FIG. 5, in a recording material non-passing area on one side end in the longitudinal direction of the fixing film 25 and the pressurizing roller 26 that are pressured to contact each other to form the fixing nip portion N, the releasing layer 26*d* of the pressurizing roller 26 is not provided and the adhesive layer 26*c* is exposed to the surface. Similarly, the conductive primer layer 25*a* of the fixing film 25 is also exposed in the recording material non-passing area. Thus, the adhesive layer 26*c* of the pressurizing roller 26 and the conductive primer layer 25*a* of the fixing film 25 contact each other to be electrically conducted. In addition, a conductive brush 32 is caused to contact the external surface of the exposed part of the conductive primer layer 25*a* of the fixing film 25, whereby the conductive brush 32 is grounded.

Therefore, charges generated on the surface of the pressurizing roller 26 by friction with the recording material P are flown to the resistance-adjusted adhesive layer 26*c* immediately below the resin layer 26*d*. The charges are further flown to the ground via the conductive primer layer 25*a* of the fixing film 25 and the conductive brush 32.

(3) Transfer bias control

Next, details of transfer bias control characterizing the present invention will be described.

As described above, a toner image on the photosensitive drum 1 is electrostatically transferred onto the recording material P by a transfer bias applied to the transfer roller 5.

Usually, the transfer bias is appropriately set according to a resistance value of a member used for the transfer roller 5 and an environment in which the image forming apparatus is used. In this embodiment, the image forming apparatus has an exclusive mode (OHT mode) in passing an OHT (resin sheet) as a recording material. If the OHT mode is selected by an input from a host computer or a direct input to the image forming apparatus, the control circuit 31 (FIG. 1) sets an output of a transfer bias from the transfer bias power source S to the transfer roller 5 lower than that in a normal operation (a mode in which plain paper is passed to be used as a recording material, i.e., a plain paper mode).

Figure 6:
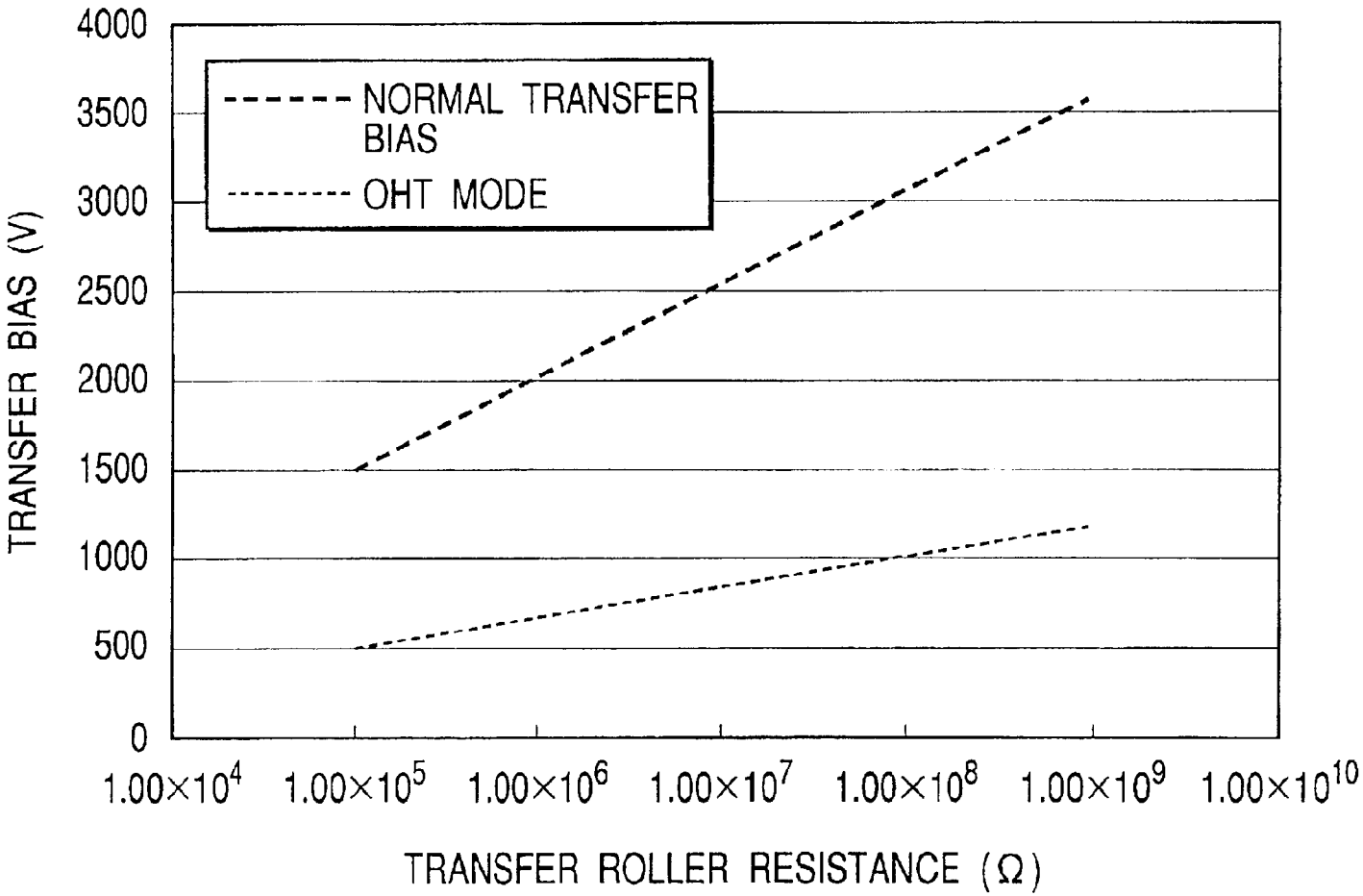
FIG. 6 is a graph showing a transfer bias output value.

For example, the image forming apparatus of this embodiment causes an output of a transfer voltage to change according to a resistance value of a transfer roller as shown in FIG. 6 in the normal operation. However, if the OHT mode is selected as opposed to this normal operation, an output value of a transfer voltage of the transfer bias power source S controlled by the transfer bias control circuit 31 is set to be one third of that in the normal operation. Note that a transfer bias value with respect to a transfer roller resistance in the image forming apparatus of this embodiment is determined based on a voltage value at the time when the transfer bias is outputted at a constant current before feeding a recording material. In addition, although the transfer bias in the OHT mode is set at one third of that of the plain paper mode in this embodiment, offset that occurs when the OHT is used can be prevented if this ratio is in a range from 3% to 80%.

As described above, the pressurizing roller 26, which has been subject to treatment for lowering resistance, inevitably generates an offset image when an OHT is passed. However, if a transfer bias applied to the back of the OHT is small in a transfer portion, negative charges induced on the surface of the OHT become small proportionate to the transfer bias. Therefore, even if transfer charges on the back of the OHT flow to the ground via the pressurizing roller 26, repulsion between toner and the negative charges becomes weaker than that in the case where a normal transfer bias is applied, and reduction of a holding power of the toner can be kept low. As a result, occurrence of an offset image can be prevented.

A lower limit value of a transfer bias applied to a transfer roller is set such that an unfixed toner image that is transferred to a recording material and held thereon does not scatter if a high resistance recording material is used. This is because, if the transfer bias is too small, charges required for holding the toner image on the recording material become insufficient and the toner image scatters immediately after passing through a transfer position. Therefore, it is necessary to set the transfer bias at a value that does not cause such scattering of the toner image.

When a recording material is an OHT, which has a high resistance, scattering of a toner image tends to occur if a transfer bias is small. However, since an image formed on the OHT is recognized by the human eye when it is projected by a projector, a little scattering of an image is hardly recognized by the human eye. Thus, a slight margin may be allowed for the lower limit value of the transfer bias. Nevertheless, since a significant reduction of the transfer bias leads to scattering of an image at an unacceptable level even on the OHT, it is necessary to appropriately set the transfer bias according to an ability of a transferring apparatus of the image forming apparatus. Thus, an output of the transfer bias in the OHT mode is set at one third of the transfer bias in the normal operation. However, if the transfer bias in the OHT mode is set in the range of 3% to 80% of that of the plain paper mode as described above, scattering of an image can be kept with an appropriate level when the OHT is used.

Results of measuring occurrence of an offset image and potentials on the front and the back of an OHT immediately before the OHT is fed in the fixing apparatus are shown in Table 1. The measurement was performed using the image forming apparatus of this embodiment (1) when the OHT mode was selected by direct input and (2) when the OHT mode was not selected (as comparison).

TABLE 1

| | | Transfer bias value | Potential of the front of the sheet | Potential of the back of the sheet | Offset |
|---|---|---|---|---|---|
| (1) | OHT mode | +900 V | −400 V | +300 V | Good |
| (2) | Normal mode | +2700 V | −1300 V | +1000 V | Fail |

As shown in Table 1, when the OHT mode was selected to form an image on an OHT, negative charges on the front of a sheet were small at −400 V and an offset image did not occur. On the other hand, if the normal mode was continued to form an image on the OHT, the negative charges on the front of the sheet were large at −1300 V, the difference in absolute value between potentials of the front and the back of the sheet was also large at 300 V, and an offset image occurred.

<Second embodiment>

Figure 7:
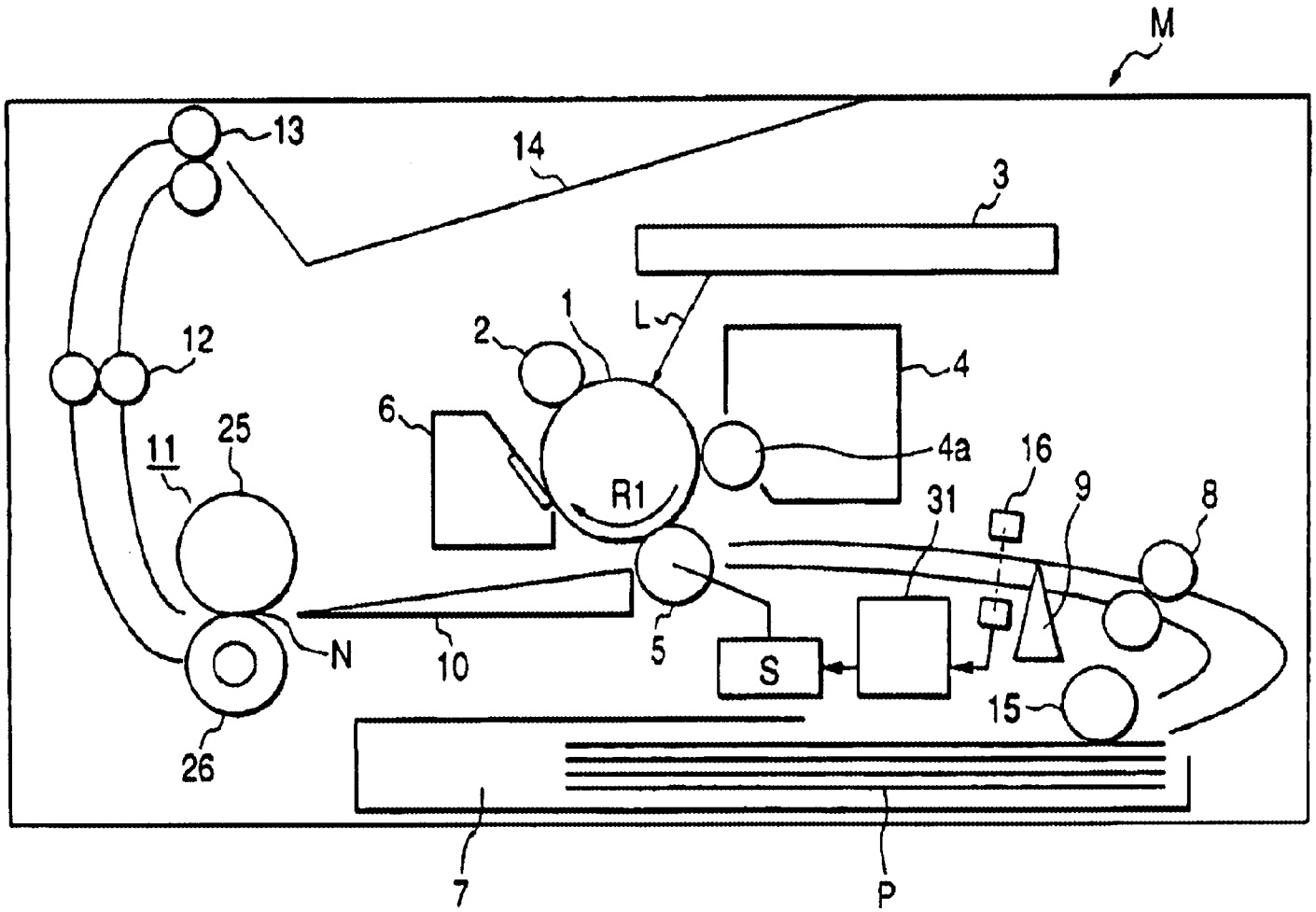
FIG. 7 is a schematic view showing a configuration of an image forming apparatus in accordance with a second embodiment.

As shown in FIG. 7, an image forming apparatus of this embodiment includes an optical sensor 16 (a light emitting side 16*a* and a light receiving side 16*b*) as OHT detecting means between the top sensor 9 and a transfer portion. The image forming apparatus can detect whether or not the passed and used recording material P is an OHT by checking transparency of the recording material P.

Detection information of the optical sensor 16 as the OHT detecting means is inputted in the control circuit 31. When feeding of the OHT is detected, the control circuit 31 controls and sets an output value of a transfer voltage from the transfer bias power source S to the transfer roller 5 to be one third of that in the normal operation.

Since the other control of the transfer bias and configuration of the image forming apparatus are the same as those in the first embodiment, repeated descriptions are omitted.

The image forming apparatus of this embodiment has the same effect of preventing offset on an OHT as the image forming apparatus of the first embodiment. However, whereas, in the image forming apparatus of the first embodiment, the OHT mode is selected by a direct input to the apparatus or by an input from a host computer, in the image forming apparatus of this embodiment, the OHT mode is selected by the image forming apparatus itself detecting the OHT. As a result, occurrence of an offset image due to failure to select the OHT mode can be prevented.

<Other embodiments>

1) In the transferring apparatus 5, a transfer member of a form such as a transfer belt or a transfer blade can be used as a contact type transfer member other than the transfer roller.

2) The fixing apparatus 11 is not limited to the heating apparatus of the pressurizing roller driving method and the film heating method of the first embodiment and may be any heating apparatus such as that of the heat roller method or an electromagnetic induction heating method. It may also be a pressure fixing apparatus.

Thus, it is seen that an image forming apparatus having a transfer bias control function is provided. One skilled in the art will appreciate that the present invention can be practiced by other than the preferred embodiments which are presented for the purposes of illustration and not of limitation, and the present invention can be modified in any way within the technical thoughts of the present invention

What is claimed is:

1. An image forming apparatus comprising:

an image bearing member;

a transfer member for transferring an image from said image bearing member to a recording material; and fixing means for fixing the transferred image onto the recording material, said fixing means including a heating member and back-up roller for forming a nip in cooperation with said heating member, wherein said back-up roller includes a conductive material containing layer, wherein said image forming apparatus is selectively operable in a normal mode if the recording material is paper and in a resin sheet mode if the recording material is a resin sheet, wherein said image forming apparatus includes transfer bias control means for controlling a voltage applied to said transfer member, and said transfer bias control means sets the voltage in accordance with a resistance value of said transfer member and a selected mode, and wherein a voltage applied to said transfer member when the resin sheet mode is selected is lower than a voltage applied to said transfer member when the normal mode is selected such that current flowing from the resin sheet to said back-up roller decreases when the resin sheet is nipped by the nip.

2. An image forming apparatus according to claim 1, wherein the voltage applied to said transfer member when the resin sheet mode is selected is in a range of 3% to 80% of the voltage applied to said transfer member when the normal mode is selected.

3. An image forming apparatus according to claim 1, wherein a resistance value of said conductive material containing layer is equal to or less than $10^{13}$ Ω/sq in terms of a surface resistance or equal to or less than $10^{11}$ Ωcm in terms of a volume resistance.

4. An image forming apparatus according to claim 1, wherein said back-up roller includes an elastic layer and a surface resin layer, and at least one of said elastic layer and said surface resin layer is said conductive material containing layer.

* * * * *

UNITED STATES PATENT AND TRADEMARK OFFICE

CERTIFICATE OF CORRECTION

PATENT NO. : 6,763,203 B2
DATED : July 13, 2004
INVENTOR(S) : Mahito Yoshioka et al.

It is certified that error appears in the above-identified patent and that said Letters Patent is hereby corrected as shown below:

Title page,
Item [56], References Cited, FOREIGN PATENT DOCUMENTS,
"62090674 A" should read -- 62-090674 --; and
"JP 7-20672 1/1995" should read -- JP 7-20672 1/1999 --.

Column 1,
Line 49, "is" should read -- is a --; and
Line 50, "layer," should read -- layer with high releasing property as a surface layer, --.

Column 6,
Line 2, "2b." should read -- 25b. --; and
Line 26, "resistance" should read -- resistance of --.

Column 9,
Line 10, "other" should read -- embodiments other --.

Signed and Sealed this

Thirtieth Day of November, 2004

JON W. DUDAS
*Director of the United States Patent and Trademark Office*